US010914447B2

(12) United States Patent
Escudero-Uribe et al.

(10) Patent No.: US 10,914,447 B2
(45) Date of Patent: Feb. 9, 2021

(54) OPTICAL WAVE GUIDED DAYTIME RUNNING LIGHTS

(71) Applicant: Continental Automotive Systems Inc., Auburn Hills, MI (US)

(72) Inventors: Apolo Zeus Escudero-Uribe, Zapopan (MX); Christian Javier Enriquez-Cervantes, Guadalajara (MX); Alejandro Hernandez Gonzalez-Barcena, Zapopan (MX)

(73) Assignee: Continental Automotive Systems, Inc., Auburn Hills, MI (US)

( * ) Notice: Subject to any disclaimer, the term of this patent is extended or adjusted under 35 U.S.C. 154(b) by 0 days.

(21) Appl. No.: 16/561,169

(22) Filed: Sep. 5, 2019

(65) Prior Publication Data

US 2020/0208801 A1 Jul. 2, 2020

Related U.S. Application Data

(60) Provisional application No. 62/786,029, filed on Dec. 28, 2018.

(51) Int. Cl.

| | |
|---|---|
| ***F21S 43/20*** | (2018.01) |
| ***F21S 13/14*** | (2006.01) |
| ***F21V 23/04*** | (2006.01) |
| ***F21S 41/20*** | (2018.01) |
| ***F21W 103/55*** | (2018.01) |

(52) U.S. Cl.

CPC ..... *F21S 43/26* (2018.01); *F21S 13/14* (2013.01); *F21S 41/285* (2018.01); *F21V 23/0464* (2013.01); *F21W 2103/55* (2018.01)

(58) Field of Classification Search

None

See application file for complete search history.

(56) References Cited

U.S. PATENT DOCUMENTS

| | | | | |
|---|---|---|---|---|
| 4,432,039 | A | 2/1984 | Cibie | |
| 4,989,956 | A | 2/1991 | Wu et al. | |
| 6,186,650 | B1 | 2/2001 | Hulse et al. | |
| 8,827,487 | B2 | 9/2014 | Farmer | |
| 9,500,333 | B1 | 11/2016 | Johnson et al. | |
| 2013/0188389 | A1 | 7/2013 | Overturf | |
| 2015/0185401 | A1* | 7/2015 | Kim | B60Q 3/64 362/612 |
| 2016/0304025 | A1 | 10/2016 | King | |

FOREIGN PATENT DOCUMENTS

| | | |
|---|---|---|
| JP | 2006294361 | 10/2006 |

* cited by examiner

*Primary Examiner* — Britt D Hanley

(57) ABSTRACT

A vehicle lamp includes a lens that has spaced apart first and second surfaces that extend to terminate at an edge. The first surface provides an exterior face of the lamp. The second surface provides an interior that contains the edge. The edge is oriented to supply a reflected light from the exterior face back through the exterior face. A light is arranged near the first surface opposite the interior. The light is configured to selectively shine light into the lens from outside the interior and supplement the reflected light.

20 Claims, 3 Drawing Sheets

OPTICAL WAVE GUIDED DAYTIME RUNNING LIGHTS

CROSS-REFERENCE TO RELATED APPLICATIONS

This application claims priority to U.S. Provisional Application No. 62/786,029, which was filed on Dec. 28, 2018.

BACKGROUND

This disclosure relates to an optical wave-guided light, for example, a light used as a daytime running light (DRL).

A typical lamp used for a vehicle has a light source arranged within a housing. A reflector is provided about the light source to reflect its light and increase the light intensity. Such headlamps are typically activated in response to a manual switch or automatically upon sensing low ambient light.

While wave guides have been used in vehicle lamp applications, the wave guides have not been optimized to take advantage of natural light, minimizing or eliminating the use of an electrical light source.

SUMMARY

In one exemplary embodiment, a vehicle lamp includes a lens that has spaced apart first and second surfaces that extend to terminate at an edge. The first surface provides an exterior face of the lamp. The second surface provides an interior that contains the edge. The edge is oriented to supply a reflected light from the exterior face back through the exterior face. A light is arranged near the first surface opposite the interior. The light is configured to selectively shine light into the lens from outside the interior and supplement the reflected light.

In a further embodiment of any of the above, the lamp is one of a daytime running light, a headlight, and a taillight.

In a further embodiment of any of the above, the edge includes a perimeter shape that provides an opening. The light is a second light. A first light is arranged in the opening. The first light when activated is configured to be brighter than the second light when activated.

In a further embodiment of any of the above, a reflective material is provided on the second surface in the interior and about the perimeter shape. The second light is arranged behind the reflective material.

In a further embodiment of any of the above, the first light is arranged proud of the edge.

In a further embodiment of any of the above, an enclosure is arranged over the light at a backside of the first surface.

In a further embodiment of any of the above, the lens includes a curved portion that terminates in the edge. The light is directed at the curved portion.

In a further embodiment of any of the above, the edge includes a doping material that is configured to change ultraviolet light within the lens to visible light exiting the edge.

In a further embodiment of any of the above, the exterior face includes a doping material that is configured to change ultraviolet light to visible light before entering the lens.

In another exemplary embodiment, a vehicle lighting system includes at least one of a switch and a sensor. A lens has spaced apart first and second surfaces that extend to terminate at an edge. The first surface provides an exterior face of the lamp. The second surface provides an interior that contains the edge. The edge is oriented to supply a reflected light from the exterior face back through the exterior face. A light is arranged near the first surface opposite the interior. The light is configured to selectively shine light into the lens from outside the interior and supplement the reflected light. A controller is in communication with the light and the at least one switch and the sensor. The controller is configured to send a command to the light to activate the light and supplement the reflected light.

In a further embodiment of any of the above, the lamp is one of a daytime running light, a headlight, and a taillight.

In a further embodiment of any of the above, the edge includes a perimeter shape that provides an opening. The light is a second light. A first light is arranged in the opening. The first light when activated is configured to be brighter than the second light when activated.

In a further embodiment of any of the above, a reflective material is provided on the second surface in the interior and about the perimeter shape. The second light is arranged behind the reflective material. The first light is arranged proud of the edge.

In a further embodiment of any of the above, the sensor includes an exterior ambient lighting sensor.

In a further embodiment of any of the above, an enclosure is arranged over the light at a backside of the first surface.

In a further embodiment of any of the above, the lens includes a curved portion that terminates in the edge. The light is directed at the curved portion.

In a further embodiment of any of the above, the edge includes a doping material that is configured to change ultraviolet light within the lens to visible light exiting the edge.

In a further embodiment of any of the above, the exterior face includes a doping material that is configured to change ultraviolet light to visible light before entering the lens.

In another exemplary embodiment, a method of providing vehicle lighting includes the steps of providing a lens that has spaced apart first and second surfaces that extend to terminate at an edge. The first surface provides an exterior face of the lamp. The second surface provides an interior that contains the edge oriented toward the exterior face. A light is reflected from the exterior face and between the first and second surfaces to the edge and back through the exterior face.

In a further embodiment of any of the above, the method includes the step that activates a light that is arranged near the first surface opposite the interior. The light shines light into the lens from outside the interior and supplements the reflected light.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
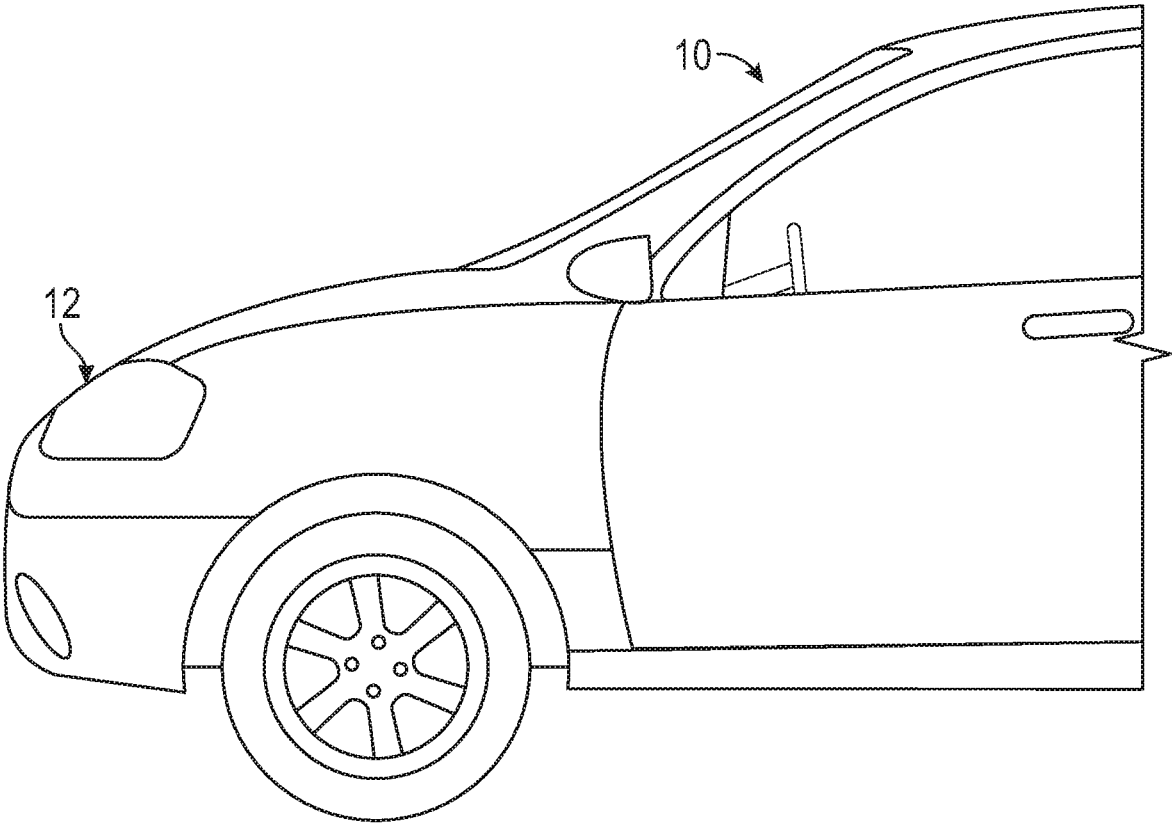
FIG. 1 schematically illustrates a vehicle with a disclosed example lamp.

A vehicle 10 is schematically shown in FIG. 1. The vehicle 10 includes a lamp 12, which may be a headlight, a taillight, or a daytime running light (DRL), for example. The disclosed lamp 12 is suitable for applications in which natural light (e.g., sunlight) is sufficient to provide the desired lighting in at least some vehicle operating conditions.

Figure 2A:
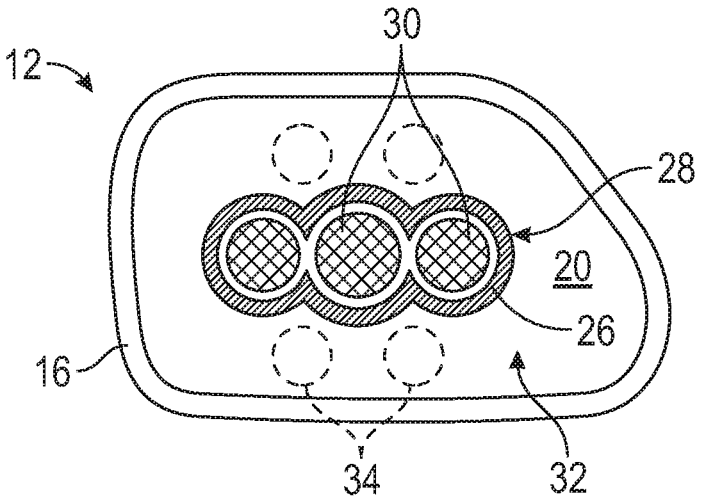
FIG. 2A is a front schematic view of the disclosed example lamp.
Figure 2B:
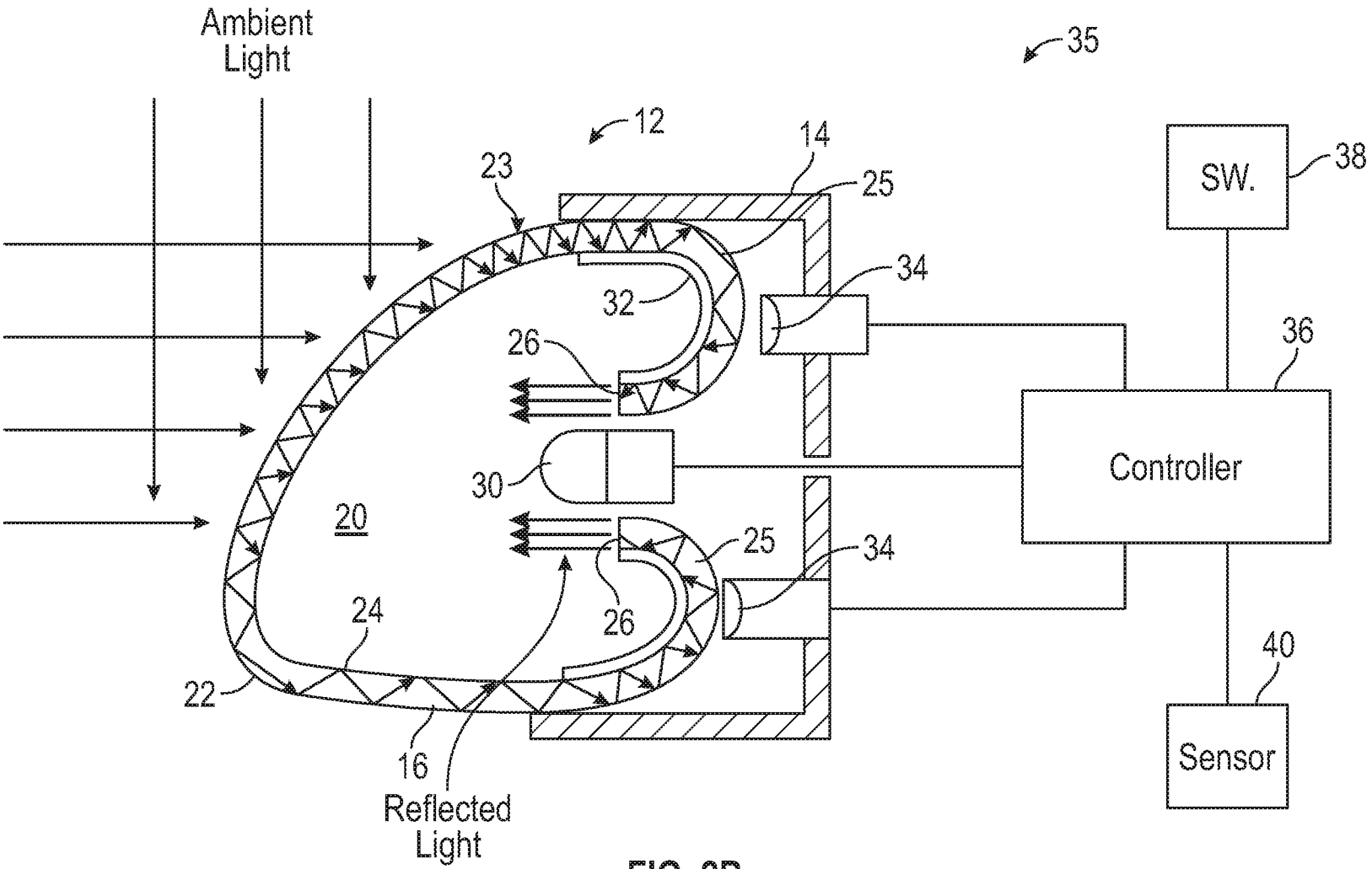
FIG. 2B is a schematic view of a vehicle lighting system and a cross-sectional view of the lamp shown in FIG. 2A.

Referring to FIGS. 2A and 2B, the lamp 12 includes a lens 16 that provides not only the outer, exterior portion or face of the lamp, but also at least a portion of the interior of the lamp that would typically be provided by a conventional reflector, although a reflector need not be provided depending on the use. The lens 16 is provided by first and second spaced apart surfaces 22, 24 defining a thickness of the lens 16. The first surface 22 provides an exterior face 23 of the lamp 12.

The first and second surfaces 22, 24 extend to and terminate in one or more edges 26 that are oriented toward the front exterior face 23 of the lens 16 where light is desired. The second surface 24 provides an interior 20 that contains the edge 26. In the example illustrated the edge 26 is arranged a generally horizontal direction and is configured in both a functional and decorative shape 28, for example, a logo of a vehicle manufacturer. The lens 16 may be constructed from any suitable material, such as acrylic or glass, that has desired toughness as well as desired reflective properties.

A first light 30 may be arranged within the perimeter of the edge 26, as shown in FIG. 2B, to provide, for example, a headlight or taillight. Reflective material 32 may be arranged about the edge 26, and the first light may be positioned proud of the edge 26. The edge 26 may function as a DRL in such a configuration As illustrated in FIG. 2B, light from the environment enters the lens 16 from a variety of directions, as indicated by the arrows. This light passes through the first surface 22 into the lens 16 and is reflected between the first and second surfaces 22, 24 until the reflected light exits through the edge 26.

Depending on the type of lamp and its application, it may be desirable to supplement the light exiting the edges 26 with additional light from one or more second lights 34 arranged near the first surface 22 opposite the interior 20. The second light 34 may be directed through the first surface 24 from a location outside of the lens 16, for example, at curved portions 25 adjacent to the edge 26, but opposite its exterior face 23 where the natural light enters. A housing 14 may be used to enclose the second lights 34.

In one example lighting configuration, the system 35 includes a controller 36 in communication with a switch 38 and a sensor 40. The first and second lights 30, 34 of the lamp 12 are operable when activated by a manual switch 38 or an ambient light sensor 40 indicating a low light condition. It should be understood that other lighting activation systems may be used and still fall within the scope of this disclosure.

Light from the exterior face 23 is reflected between the first and second surfaces 22, 24 to the edge 26 and back through the interior 20 and out the exterior face 23. The lens material of a typical lamp may serve as a wave guide for sunlight. The sunlight is captured through all of the surfaces of the lens and the light is concentrated and reemitted through the narrow edges 26. The amplification of the brightness generally corresponds to the ratio between the equivalent external surfaces of the lens 16 divided by the surface of the edge 26. If more brightness is required, additional lighting can be provided using the second lights 34. The visible light received by and reflected within the lamp 12 may be supplemented with UV light that is converted to visible light.

Figure 3:
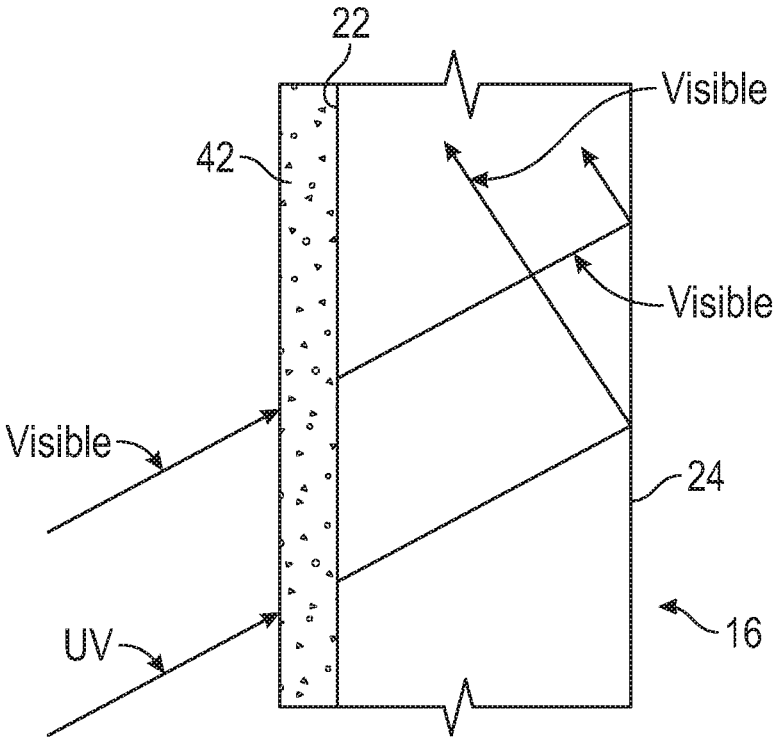
FIG. 3 is a schematic view of a lens for a vehicle lamp having a doped surface.
Figure 4:
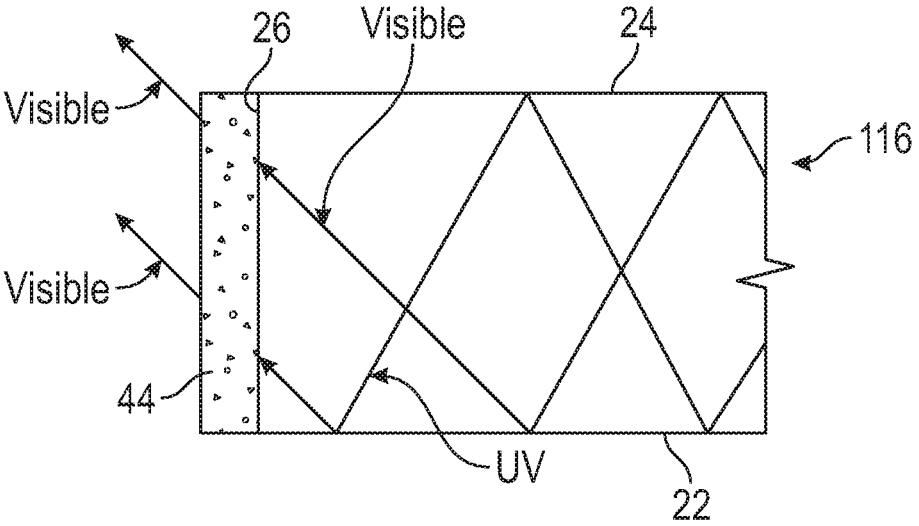
FIG. 4 is a schematic view of a lens for a vehicle lamp having a doped edge where reflected light exits the lens.

In one example illustrated in FIG. 3, a doping material 42 is arranged on a first surface 22. When the UV light passes through the doping material 42, the wavelength is shifted to the visible light range. Another arrangement is illustrated in FIG. 4 in which the doping material 44 is provided on the edge 26 of the lens 116. The UV light reflected between the first and second surfaces 22, 24 is shifted to the visible light spectrum upon passing through the doping material 44 when exiting the edge 26. Alternatively or additionally, the doping material 44 may be fluorescent to increase reflectivity.

The surface of the lens 16 is more reflective when the angle of incidence is lesser than the normal angle. When the density of the lens 16 changes near the surface, the reflectiveness increases. When the output surface, i.e., the edge 26 is coated with fluorescence materials, e.g., the doping material 44, the brightness of the output is increased. Ultraviolet rays from the sun can also be converted to visible light increasing the brightness of the lamp 12.

The disclosed lamps are visible even when they are turned off. The edges 26 may be configured to provide a distinctive design. The lamp 12 also provides an energy saving sensor that requires smaller lamps with lower current requirements, which increases the useful life of the lamp 12.

Wave guides provided in the prior art have internal prisms to reflect the light to a desired direction, but they are not a true wave guide. The disclosed lamp uses surfaces made with a density gradient to increase the reflective index. The one or more surfaces of the lens 16 may be doped with rare earths to transform the ultraviolet light to visible light.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A vehicle lamp comprising:

a lens having spaced apart first and second surfaces that extend to terminate at an edge, the first surface providing an exterior face of the lamp, and the second surface providing an interior cavity containing the edge, the edge oriented to supply a reflected light from the exterior face back through the exterior face; and a light source arranged near the first surface opposite the interior cavity, the source light configured to selectively shine light into the lens from outside of the interior cavity and supplement the reflected light.

2. The lamp of claim 1, wherein the lamp is one of a daytime running light, a headlight, and a taillight.

3. The lamp of claim 1, wherein the edge includes a perimeter shape providing an opening, the light source is a second light, and a first light is arranged in the opening, and the first light when activated is configured to be brighter than the second light when activated.

4. The lamp of claim 3, wherein a reflective material is provided on the second surface in the interior cavity and about the perimeter shape, the second light is arranged behind the reflective material.

5. The lamp of claim 4, wherein the first light is arranged proud of the edge.

6. The lamp of claim 1, comprising an enclosure arranged over the light source at a backside of the first surface.

7. The lamp of claim 1, wherein the lens includes a curved portion terminating in the edge, the light directed at the curved portion.

8. The lamp of claim 1, wherein the edge includes a doping material configured to change ultraviolet light within the lens to visible light exiting the edge.

9. The lamp of claim 1, wherein the exterior face includes a doping material configured to change ultraviolet light to visible light before entering the lens.

10. A vehicle lighting system comprising:

at least one of a switch and a sensor;

a lens having spaced apart first and second surfaces that extend to terminate at an edge, the first surface providing an exterior face of the lamp, and the second surface providing an interior cavity containing the edge, the edge oriented to supply a reflected light from the exterior face back through the exterior face;

a light source arranged near the first surface opposite the interior cavity, the light source configured to selectively shine light into the lens from outside of the interior cavity and supplement the reflected light; and a controller in communication with the light source and the at least one switch and the sensor, the controller configured to send a command to the light source to activate the light source and supplement the reflected light.

11. The system of claim 10, wherein the lamp is one of a daytime running light, a headlight, and a taillight.

12. The system of claim 11, wherein the edge includes a perimeter shape providing an opening, the light source is a second light, and a first light is arranged in the opening, and the first light when activated is configured to be brighter than the second light when activated.

13. The system of claim 12, wherein a reflective material is provided on the second surface in the interior cavity and about the perimeter shape, the second light is arranged behind the reflective material, wherein the first light is arranged proud of the edge.

14. The system of claim 11, wherein the sensor includes an exterior ambient lighting sensor.

15. The system of claim 10, comprising an enclosure arranged over the light at a backside of the first surface.

16. The system of claim 10, wherein the lens includes a curved portion terminating in the edge, the light directed at the curved portion.

17. The system of claim 10, wherein the edge includes a doping material configured to change ultraviolet light within the lens to visible light exiting the edge.

18. The system of claim 10, wherein the exterior face includes a doping material configured to change ultraviolet light to visible light before entering the lens.

19. A method of providing vehicle lighting, comprising the steps of:

providing a lens having spaced apart first and second surfaces that extend to terminate at an edge, the first surface providing an exterior face of the lamp, and the second surface providing an interior cavity containing the edge oriented toward the exterior face; and reflecting a light from the exterior face and between the first and second surfaces to the edge and back through the exterior face.

20. The method of claim 19, comprising the step activating a light source arranged near the first surface opposite the interior cavity, the light source shining light into the lens from outside of the interior cavity and supplementing the reflected light.

* * * * *